US007621024B2

(12) United States Patent
Lawler

(10) Patent No.: US 7,621,024 B2
(45) **Date of Patent: *Nov. 24, 2009**

(54) WINDOW EGRESS ASSISTANCE HANDLE

(76) Inventor: Frederick Gregory Lawler, 723 Hawk Ln., Coppell, TX (US) 75019

( * ) Notice: Subject to any disclaimer, the term of this patent is extended or adjusted under 35 U.S.C. 154(b) by 0 days.

This patent is subject to a terminal disclaimer.

(21) Appl. No.: 11/983,586

(22) Filed: Nov. 9, 2007

(65) Prior Publication Data

US 2008/0060164 A1 Mar. 13, 2008

Related U.S. Application Data

(63) Continuation of application No. 11/047,978, filed on Feb. 1, 2005, now Pat. No. 7,302,736.

(60) Provisional application No. 60/541,106, filed on Feb. 2, 2004.

(51) Int. Cl.
*E05B 1/00* (2006.01)

(52) U.S. Cl. ..... 16/444; 16/443; 16/422; 16/426

(58) Field of Classification Search ..... None
See application file for complete search history.

(56) References Cited

U.S. PATENT DOCUMENTS

| | | | | | |
|---|---|---|---|---|---|
| 145,132 | A * | 12/1873 | Smith | 16/433 |
| 1,491,045 | A * | 4/1924 | Johnson | 294/26 |
| 2,450,193 | A * | 9/1948 | Galliano | 294/27.1 |
| 2,642,581 | A * | 6/1953 | Loe | 4/577.1 |
| 2,777,729 | A * | 1/1957 | Nieratko | 297/411.22 |
| 3,263,267 | A * | 8/1966 | Ahlberg | 16/422 |
| 4,829,976 | A * | 5/1989 | Pourtau et al. | 125/36 |
| 6,711,784 | B2 * | 3/2004 | Walker | 16/436 |

* cited by examiner

*Primary Examiner*—Jack W. Lavinder

(57) ABSTRACT

A window operation assistance handle having a base, at lease one finger grip with two legs, multiple offset orifice fixation ports for receiving multiple securing devices such as set-screws or thumbscrews, and a base hollow groove. To temporarily install and use the handle, the handle is positioned to envelope an integrated leverage point in the hollow groove, and the securing devices disposed in the multiple offset orifice fixation ports are engaged to create a non-penetrating compressive friction fit upon enveloped leverage point. The window can then be lifted or slid by applying force to the finger grips. The handle can be adjusted to the user's strength, size, and dimensions, and installed and removed without use of tools or creating permanent damage of the framework of the window.

10 Claims, 3 Drawing Sheets

WINDOW EGRESS ASSISTANCE HANDLE

CROSS-REFERENCE TO RELATED APPLICATIONS

This is a continuation of application Ser. No. 11/047,978, filed Feb. 1, 2005, now U.S. Pat. No. 7,302,736 which claims the benefit of Provisional Application No. 60/541,106, filed Feb. 2, 2004 by Gregory Lawler.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

U.S. Provisional Application No. 60,541,106, and Non-Provisional patent Ser. No. 11/047,978 are hereby incorporated by reference in their entirety, including figures.

BACKGROUND OF THE INVENTION

1. Field of the Invention

This invention relates to window opening assistance devices for anyone needing assistance opening a window, especially in emergency situations.

2. Background of the Invention

Windows in dwellings can become difficult to open. This is due to post construction changes in a structure. Changes that frequently occur are shrinking and swelling of the window unit due to exposure of extreme elements of weather such as heat, cold, dry or moist atmospheres. Over time many structures may experience shifting due to ground movement and gravity. Dirt deposits collect due to poor maintenance. These post construction changes can cause the window to become difficult to open.

Many windows integrate a dedicated lift area. However, many times this area is not sufficient regarding the size and strength of the occupant desiring to open the window.

This clearly puts occupants at a great disadvantage when needing to make an emergency exit. This is evident by the fact that there are two ways out of a home in the event of fires. Yet 800 children under the age of nine die each year in home fires. The problem of window egress is clear and can be addressed properly by the use of my invention. Proper education and encouragement by professional and volunteer fire-fighters is only available after engineering process is complete. Our invention must be first available.

It is estimated by the firefighting profession that 60-90% of home dwellers do not practice fire drills. To highlight the importance of our invention could save many lives. After Sep. 11, 2001, the Department of Homeland Security cited that terrorists could threaten soft targets. This included family dwellings. As fire-fighters, we have a response obligation of duty to protect America from harm at every level concerning safety. The most important problem our invention will solve is allowing us as firefighters to give children a solid answer to their most common question, which is, "What do I do if the window won't open during a fire and that is my only way out?" Today, firefighters across the country answer "Do whatever it takes." This is not a good plan.

Window lift areas are usually integrated into the framework of the window by manufacturers. Historically, these are small and present a challenge to the finger-tip strength of many users, especially the young and others who have dexterity deficits. Additional handles may be obtained when minimal or no integrated lift design exists. These additional handles require skill to ensure proper mounting. These handles are usually screwed into the framework and the margin for error by the untrained installer can range from crooked handles to non-repairable holes in the framework of the window. Placement errors can cause the handle to become less effective. Placement issues are of great importance to the end user. Other handles do not allow movement or adjustment to meet the optimum position for the user whose needs may change, without leaving unsightly holes when adjusting. Optimum leverage is required during the lifting, pushing, or pulling action during sliding operation due to the physical changes of the user. If people of different sizes change living quarters, it requires possible different position placement in order to optimize leverage. Additionally, when one moves form one dwelling to another, to remove other handles again leaves unsightly holes in the window framework.

SUMMARY OF THE INVENTION

My invention is a handle, which applies force to an existing window leverage point. The handle provides greater surface area for grasping, therefore allowing the user to leverage any additional available strength for the purpose of assistance in the opening and closing operation of the window.

BRIEF DESCRIPTION OF THE DRAWINGS

The present embodiment should be more fully understood when the written description is considered in conjunction with the drawings contained herein, wherein.

DETAILED DESCRIPTION OF THE INVENTION

Figure 1:
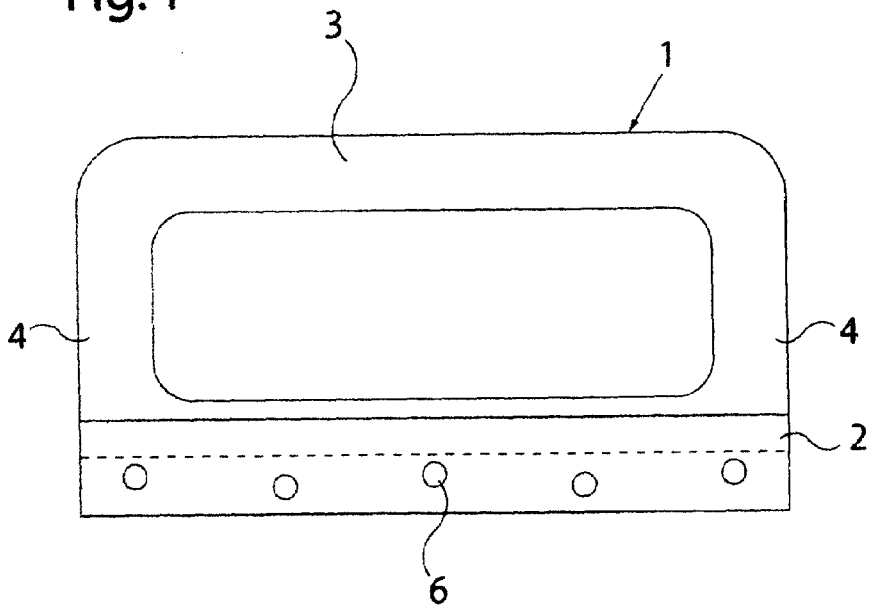
FIG. 1 shows a front view of the entire window operation assistance handle (1) with a base (2), a finger grip (3) two legs (4) and multiple offset orifice ports for various securing devices.
Figure 2:
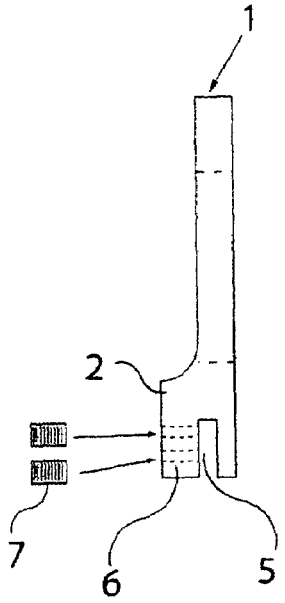
FIG. 2 shows a side view of the window operation assistance handle (1) with a base (2), the base hollow groove (5), multiple offset orifice fixation ports for various securing devices (6) with setscrews (7).
Figure 3:
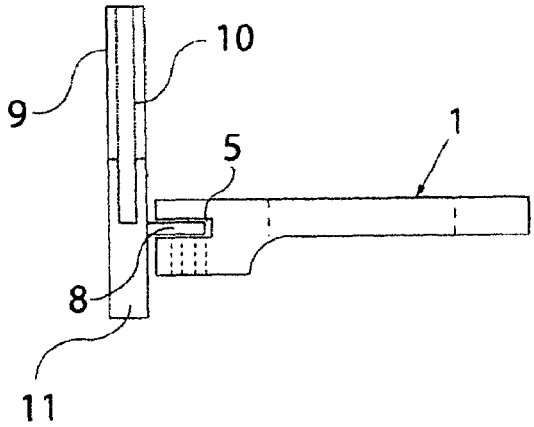
FIG. 3 provides a side view of the window operation assistance handle (1) positioned for attachment by placing the base hollow groove (5) as to envelope the integrated leverage point (8) that is part of the bottom rail (11) which is attached to a side window stile (9) which holds the windowpane glass (10).
Figure 4:
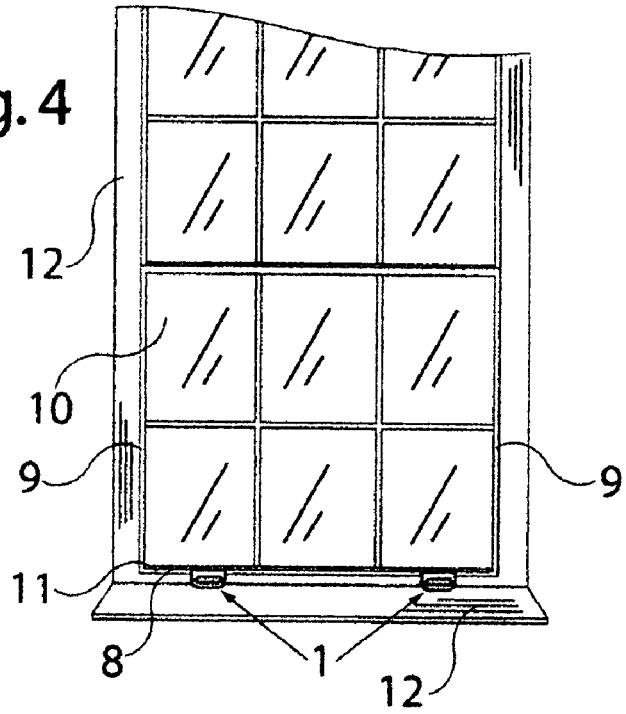
FIG. 4 includes a window frame (12) showing window stiles (9) with a bottom rail (11) and a top rail (not shown) that houses a windowpane glass (10). The bottom rail (11) has an integrated leverage point (8) which shows two window operation assistance handles (1) attached.
Figure 5:
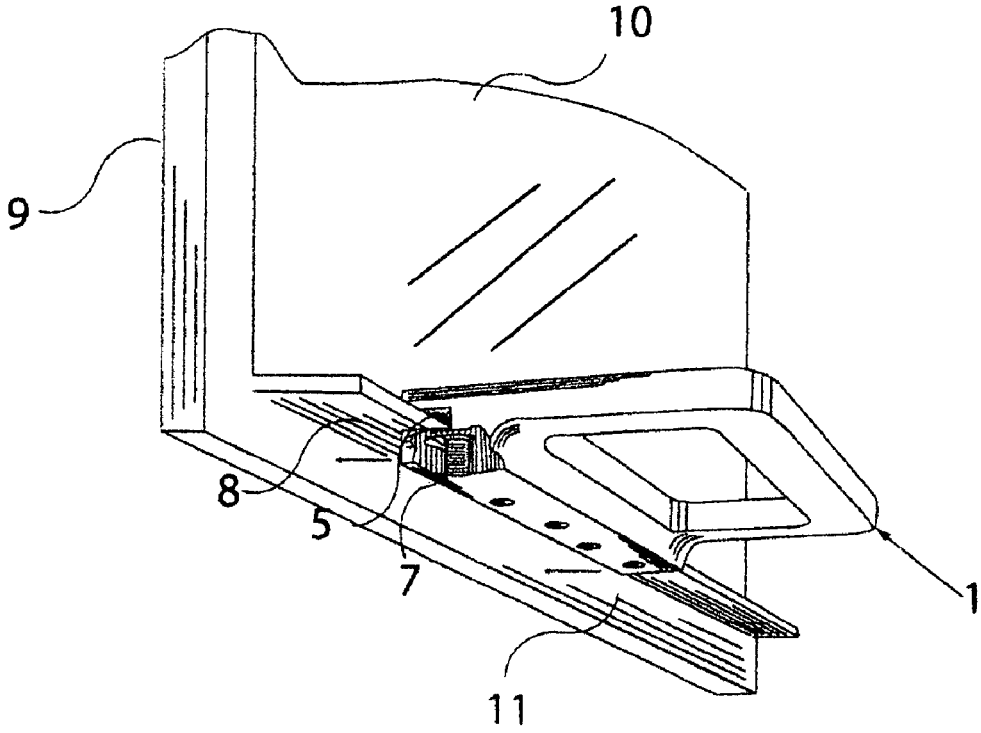
FIG. 5 shows a partial view of a window stile (9), window pane glass (10), and a bottom rail (11). A bottom view of the cutaway window operation assistance handle (1) positioned with the base hollow groove (5) enveloping the integrated leverage point (8) temporarily attached by setscrews (7).
Figure 6:
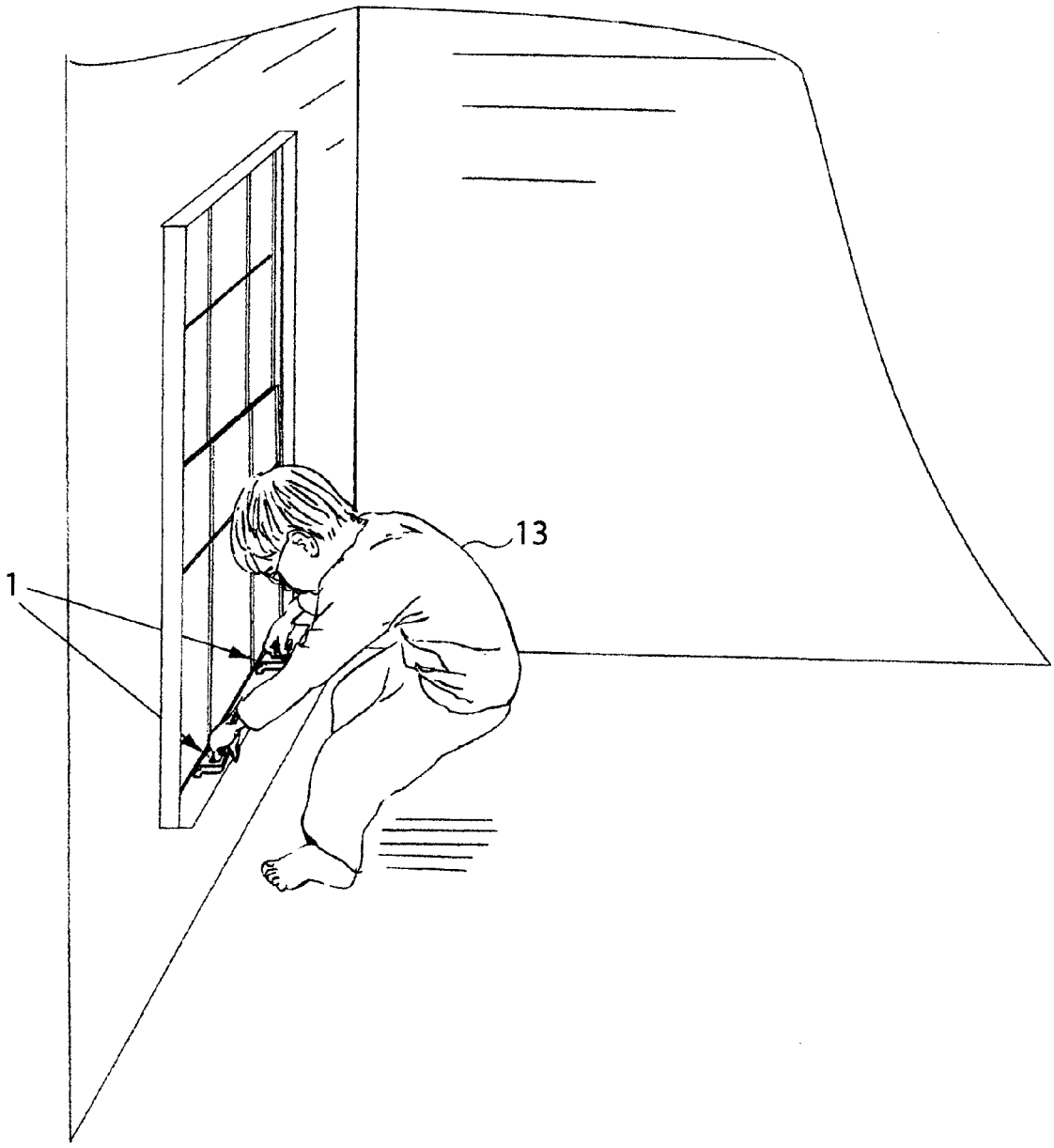
FIG. 6 shows a person (13) using the handles without fasteners wherein the base contacts a leverage point to confidently urge a leverage point as the two base members capture opposite contact points of a leverage point to create a binding therefore confidently urging a leverage point, (1) after mounting.

As shown in FIG. 1, a window operation assistance handle (1) made of resilient material, which could be of any color and flexible enough to provide an operating range that allows a varied degree of angles that occur in material while urging any material at a leverage point. The handle could also be made as a unitary piece or likewise comprised of two pieces of resilient material fastened together to create a non-penetrating compressive friction fit binding both surfaces of the a leverage point (8). The handle includes a base (2), a finger grip (3) with two legs (4) one being coplanar to the finger grip and of which one leading edge could be beveled secured by multiple offset orifice fixation ports for various securing devices (6) such as set screws or thumb screws (7) to create a non-penetrating compressive friction fit. The base hollow groove (5) is shown throughout FIG. 2 and FIG. 3. A window stile (9) with a windowpane glass (10) and a bottom rail (11) with an integrated leverage point (8) that receives the window operation assistance handle (1) by enveloping the base hollow groove (5). Two handles (1) are temporarily mounted on an integrated leverage point (8) as shown in FIG. 4. FIG. 5 is a bottom view of FIG. 3. FIG. 6 shows a person (13) using that window operation assistance handles (1) after mounting.

To use our window operation assistance handle invention, locate the subject window leverage points for windows. The device is mounted by placing the hollow groove (5) into position as to envelop a leverage point (8) such that urging may be accomplished without the use of a fastener by urging angular tilt to bind and capture the leverage point or which can be held securely in place temporarily by use of setscrews (7) that are disposed in the multiple offset orifice fixation ports (6).

The handle (1) assists the user in opening the window after the window is unlocked. The user grasps the handle (1) and lifts, pushes or pulls. The handle (1) provides greater surface area for grasping, allowing the user to leverage any additional available strength for the purpose of assistance in the opening and closing operation of the window, especially in emergency situations.

What is claimed is:

1. An apparatus used by a human urging a window leverage point comprising:

a resilient piece of plate like material of sufficient size for use by a human hand and is resilient vet flexible in providing an operating range that allows varied degrees of angles while urging a leverage point; at least two base members bounding a hollow groove to sandwich a leverage point, one said base member is coplanar with a finger grip; at least one fixation port penetrating at least one of said base members, with at least one fastener disposed, said fastener creating a non-penetrating compressive friction fit for contiguous sandwiching of said one base member to a leverage point and creating a non-permanent attachment.

2. The device as set forth in claim 1 wherein said base is comprised of two pieces fastened together to form a compressive force binding both surfaces of a leverage point.

3. The device as set forth in claim 1 wherein said at least one base member has a leading edge that is beveled.

4. The device as set forth in claim 1 wherein said resilient material of sufficient size for use by a human hand has a hole to allow said human hand to pass through said resilient material.

5. A method for extending a movable leverage point by joining at least two pieces of resilient material together for urging comprising the steps of;

(a) providing at least one piece of resilient material sufficient for use by a human hand with a base having at least two members and a hollow groove formed therein, at least one said base member is coplanar with a finger grip and has at least one fixation port and at least one fastener disposed therein, (b) positioning said groove as to envelop a leverage point; and (c) securing at least one said fastener to create a non-penetrating compressive friction fit against a leverage point such that urging may occur on a now extended leverage point, whereby when said at least one piece of resilient material is engaged with a leverage point urging may occur.

6. The method of claim 5 wherein said at least one piece of resilient material is colored.

7. The method of claim 5 wherein at least one piece of resilient material is flexible.

8. A method for extending a movable leverage point by joining at least 2 pieces of resilient material for urging comprising the steps of;

(a) providing at least one piece of resilient material sufficient for use by a human hand with a base having at least two members and a hollow groove formed therein, at least one base member is coplanar with a finger grip, and (b) positioning said hollow groove as to envelop a leverage point such that urging may be accomplished without the use of said fastener by substantially surrounding a leverage point for urging, whereby when said at least one piece of resilient material is engaged with a leverage point urging may occur.

9. The method of claim 8 wherein said at least one piece of resilient material is colored.

10. The method of claim 8 wherein said at least one piece of resilient material is flexible.

* * * * *